US010463564B2

(12) United States Patent
Chung et al.

(10) Patent No.: US 10,463,564 B2
(45) Date of Patent: Nov. 5, 2019

(54) CARPAL TUNNEL SYNDROME REHABILITATION DEVICE

(71) Applicant: Kun-Yen Chung, Tainan (TW)

(72) Inventors: Kun-Yen Chung, Tainan (TW); Chih-Ming Kung, Tainan (TW)

(73) Assignee: Kun-Yen Chung, Tainan (TW)

( * ) Notice: Subject to any disclaimer, the term of this patent is extended or adjusted under 35 U.S.C. 154(b) by 417 days.

(21) Appl. No.: 15/355,072

(22) Filed: Nov. 18, 2016

(65) Prior Publication Data

US 2017/0156966 A1 Jun. 8, 2017

(30) Foreign Application Priority Data

Dec. 7, 2015 (TW) ..... 104140892 A

(51) Int. Cl.
*A61H 7/00* (2006.01)
*A61H 1/00* (2006.01)
*A61H 39/04* (2006.01)

(52) U.S. Cl.
CPC ..... *A61H 7/001* (2013.01); *A61H 1/008* (2013.01); *A61H 39/04* (2013.01); *A61H 2201/1261* (2013.01); *A61H 2201/168* (2013.01); *A61H 2201/1635* (2013.01); *A61H 2201/1695* (2013.01)

(58) Field of Classification Search
CPC ..... A61H 1/008; A61H 7/001; A61H 39/04; A61F 5/0118; A61F 5/013; A61F 5/05866
See application file for complete search history.

(56) References Cited

U.S. PATENT DOCUMENTS 3,970,081 A * 7/1976 Applegate, Jr. ..... A61F 13/108 128/95.1
5,441,058 A * 8/1995 Fareed ..... A61F 5/0118 128/878
6,027,521 A * 2/2000 Ourada ..... A61B 17/00 606/204
6,120,472 A * 9/2000 Singer, Jr. ..... A61F 13/108 602/20
7,637,883 B2 * 12/2009 Nyi ..... A61F 5/30 602/20
2003/0130690 A1 * 7/2003 Porrata ..... A61F 5/0118 606/204
2015/0320637 A1 * 11/2015 Henre ..... A61H 15/00 601/132

* cited by examiner

*Primary Examiner* — Valerie L Woodward
(74) *Attorney, Agent, or Firm* — Leong C. Lei

(57) ABSTRACT

A rehabilitation device for treating carpal tunnel syndrome and tennis elbow is disclosed. The rehabilitation device includes upper and lower members clamping a wrist from above and below. An upper bulge element and a lower bulge element are correspondingly positioned in the middle of the inner faces of the upper and lower members, respectively, for pressing against a gap between the ulna and radius of the wrist from above and below. The upper member has two positioning elements on the inner face to the lateral sides of the upper bulge element. A strap wraps around outer faces of the upper and lower members so as to tight the upper and lower members on the wrist from above and below. By swinging the palm up and down, the bulge elements press into the gap and provide massage and relaxation to the ligament inside.

9 Claims, 4 Drawing Sheets

CARPAL TUNNEL SYNDROME REHABILITATION DEVICE

BACKGROUND OF THE INVENTION (a) Technical Field of the Invention

The present invention is generally related to carpal tunnel syndrome, and more particular to a rehabilitation device for relaxing the ligament in the carpal tunnel.

(b) Description of the Prior Art

Modern people suffer various pain and sore due to their immobile postures and repetitive actions in their lives, works, and exercises. Two common sources of pain and sore are the ligament adhesion resulted from the carpal tunnel syndrome and the epicondylitis (tennis elbow). These illnesses do not involve bones but are pathological changes out of the fatigue of ligaments. Their treatment is often through pain relief by drug medication and rehabilitation in parallel. However drug medication may very possibly lead to side effects, and rehabilitation takes a lengthy period of time. Conventional rehabilitation is usually through thermal patch or stretching, which is of little effect to injuries rooted deeply in the wrist such as the carpal tunnel syndrome. Therefore operation is often applied as an ultimate solution. In other words, existing rehabilitation devices, despite their abundance and variety, still lack those aiming for the healing and rehabilitation to illnesses like carpal tunnel syndrome and tennis elbow, which are so common to the modern office workers. Therefore, there is an urgent need for such rehabilitation devices.

SUMMARY OF THE INVENTION

To resolve the pain and discomfort from carpal tunnel syndrome and tennis elbow, a novel rehabilitation device is disclosed herein where, by simple swinging of the palm upward and downward, the wrist ligament is simultaneously massaged and relaxed, thereby easing the pain and discomfort of carpal tunnel syndrome. With the present invention, a user without special technique may still conduct simple and effective self-rehabilitation to the wrist and elbow.

The rehabilitation device includes upper and lower members clamping a wrist from above and below. An upper bulge element and a lower bulge element are correspondingly positioned in the middle of the inner faces of the upper and lower members, respectively, for pressing against a gap between the ulna and radius of the wrist from above and below. The upper member has two positioning elements on the inner face to the lateral sides of the upper bulge element to reliably position the rehabilitation device. A strap wraps around outer faces of the upper and lower members so as to tight the upper and lower members on the wrist from above and below. By swinging the palm up and down, the bulge elements press into the gap and provide massage and relaxation to the ligament inside.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
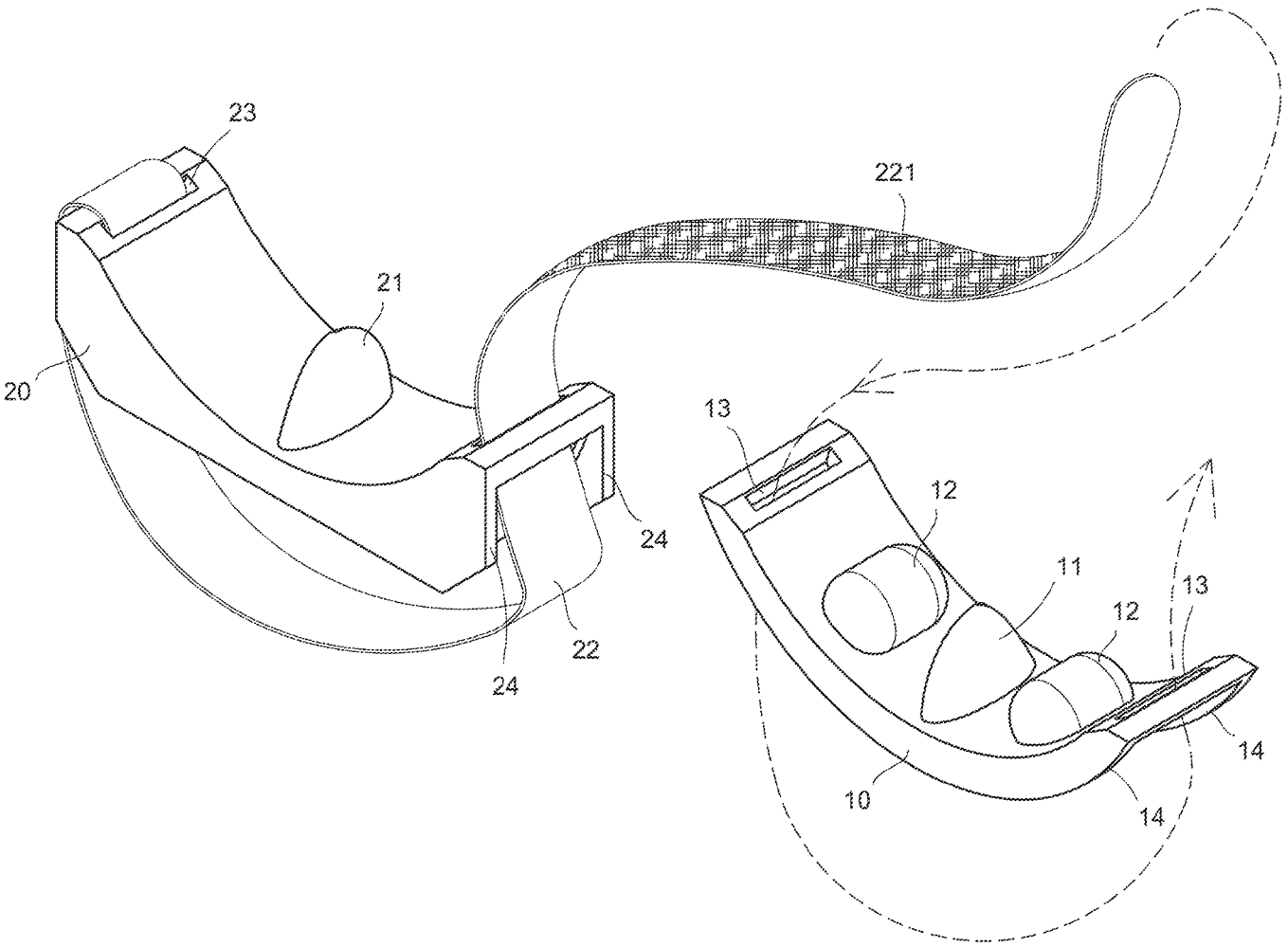
FIG. 1 is a perspective diagram showing a carpal tunnel syndrome rehabilitation device according to an embodiment of the present invention.
Figure 2:
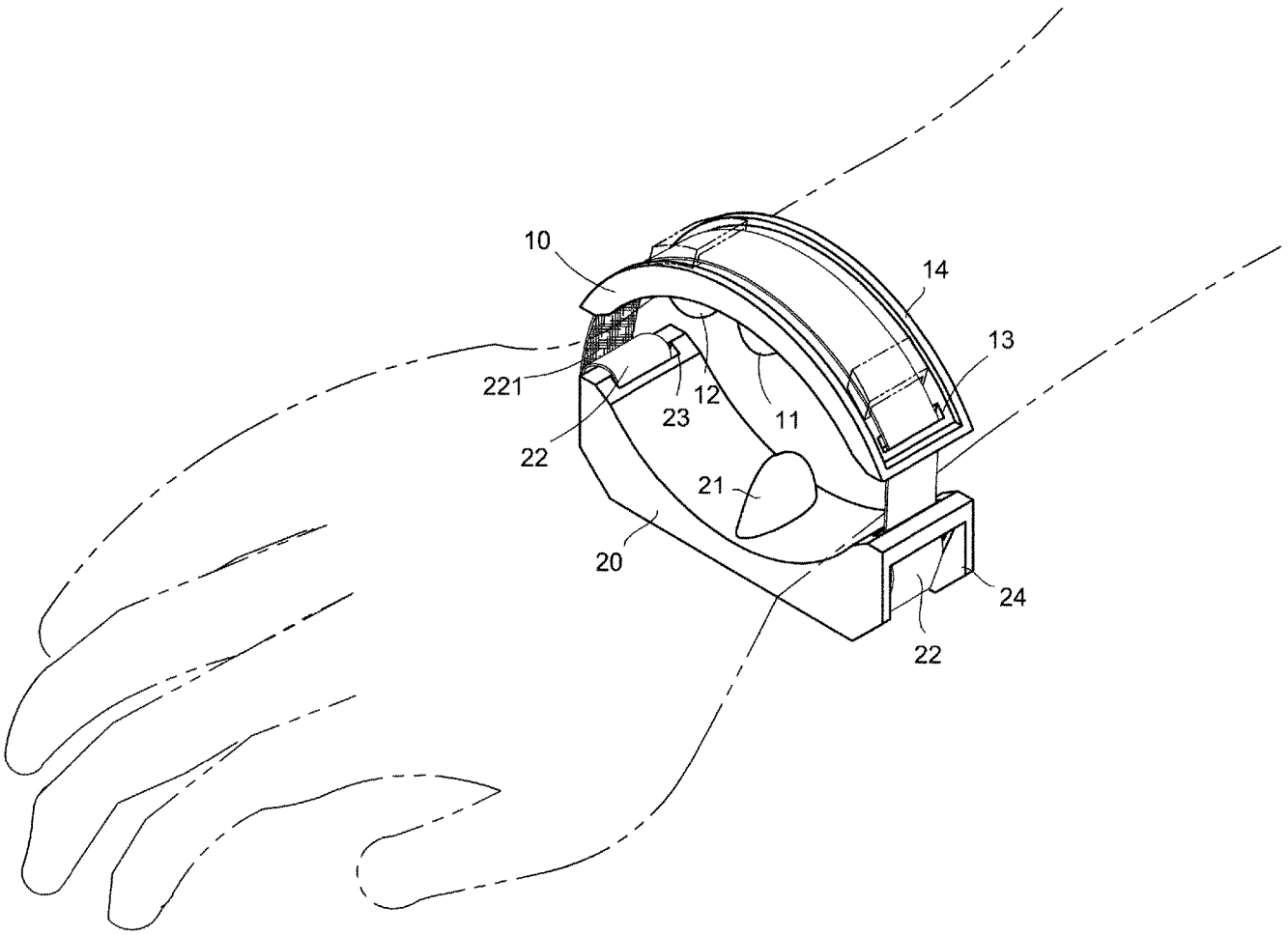
FIG. 2 is a perspective schematic diagram showing an application scenario the carpal tunnel syndrome rehabilitation device of FIG. 1.
Figure 3:
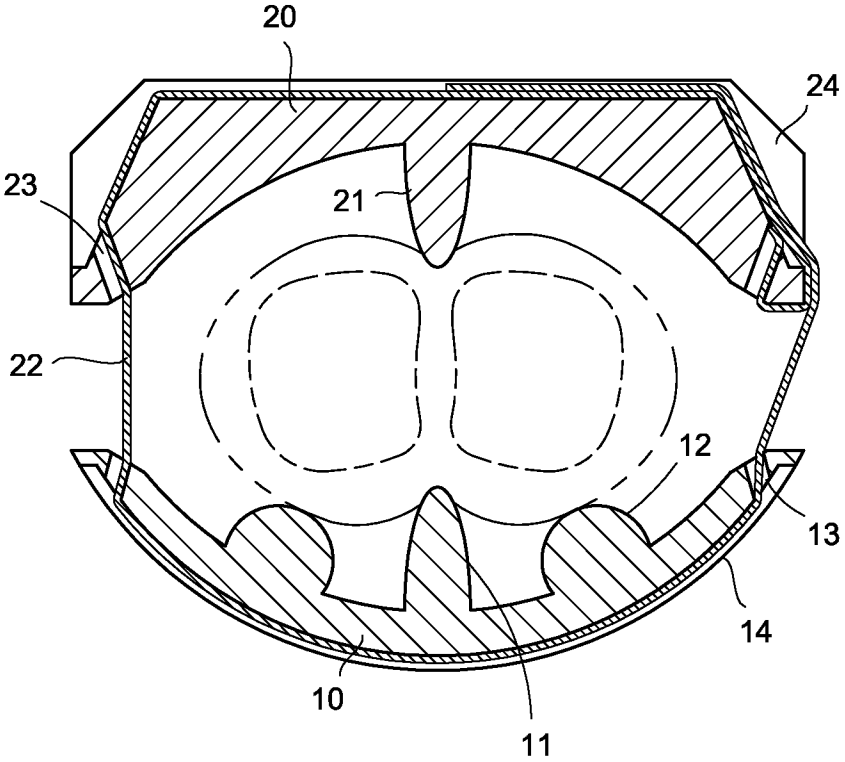
FIG. 3 is schematic cross-sectional diagram showing the carpal tunnel syndrome rehabilitation device of FIG. 2.

The present invention provides a rehabilitation device for relaxing the ligament in the carpal tunnel. As shown in FIGS. 1 to 3, the rehabilitation device includes upper member 10 and lower member 20 having crescent-shaped inner faces. The upper and lower members 10 and 20 have a length about 3 cm, and have bulge elements 11 and 21 correspondingly positioned in the middle of their inner faces, respectively. The bulging elements 11 and 21 have a height between 15 and 18 mm and a roughly oval-shaped base with a width between 10 and 15 mm and a length about 20 mm. The base's length is slightly smaller than the width of the upper and lower members 10 and 20. The bulge elements 11 and 21 shrink gradually from their bases outward for 5 to 10 mm. The two ends of each base have widths slightly smaller than the width of the base for 5 to 8 mm, thereby forming a thin and flat cone-like shape similar to a bamboo shoot. For the upper member 10, there are two capsule-shaped positioning elements 12 on the inner face to the lateral sides of the bulge element 11. The positioning elements 12 is slightly lower than the bulge element 11. When the upper member 10 is placed on a wrist of a user with the inner face facing the wrist, the bulge element 11 would be against a gap between the ulna and radius adjacent to the ligament. The two positioning elements 12, by pressing the lateral sides of the wrist, provide positioning support and prevent the upper member 10 from displacement. The lower member 20, besides having similar curved inner face and bulge element, has a flat bottom side. When the wrist is sandwiched between the upper and lower members 10 and 20, the bulge element 21 of the lower member 20 presses against the gap between the ulna and radius adjacent to the ligament from below. A strap 22 is then threaded through slot openings 13 and 23 located respectively at two ends of the upper and lower members 10 and 20. Alternatively, the slot openings 13 and 23 may be configured on ear pieces extended from the two ends of the upper and lower members 10 and 20, respectively. The strap 22 has a fastener section 221 on one side so that the strap 22 locks to itself after forcing the upper and lower members 10 and 20 to provide a comfortable and reliable grip on the wrist. To place the strap 22 accurately on outer faces of the upper and lower members 10 and 20, walls 14 and 24 are provides along two main edges of the outer faces of the upper and lower members 10 and 20, respectively, so that the strap 22 does not slip outside the outer faces of the upper and lower members 10 and 20. After the strap 22 tightly binds the upper and lower members 10 and 20 to the wrist, the bulge elements 11 and 21 clamp the gap between the ulna and radius from above and below. Then, by flipping the palm and swinging the palm up and down, the bulge elements 11 and 21 squeeze into the gap and relax the ligament. In the meantime, the upper and lower members 10 and 20 are always positioned correctly without displacement and slack. As such, the ligament within the carpal tunnel is naturally stretched and massaged. The carpal tunnel syndrome resulted from the ligament's adhesion is therefore eased and rehabilitated.

Figure 4:
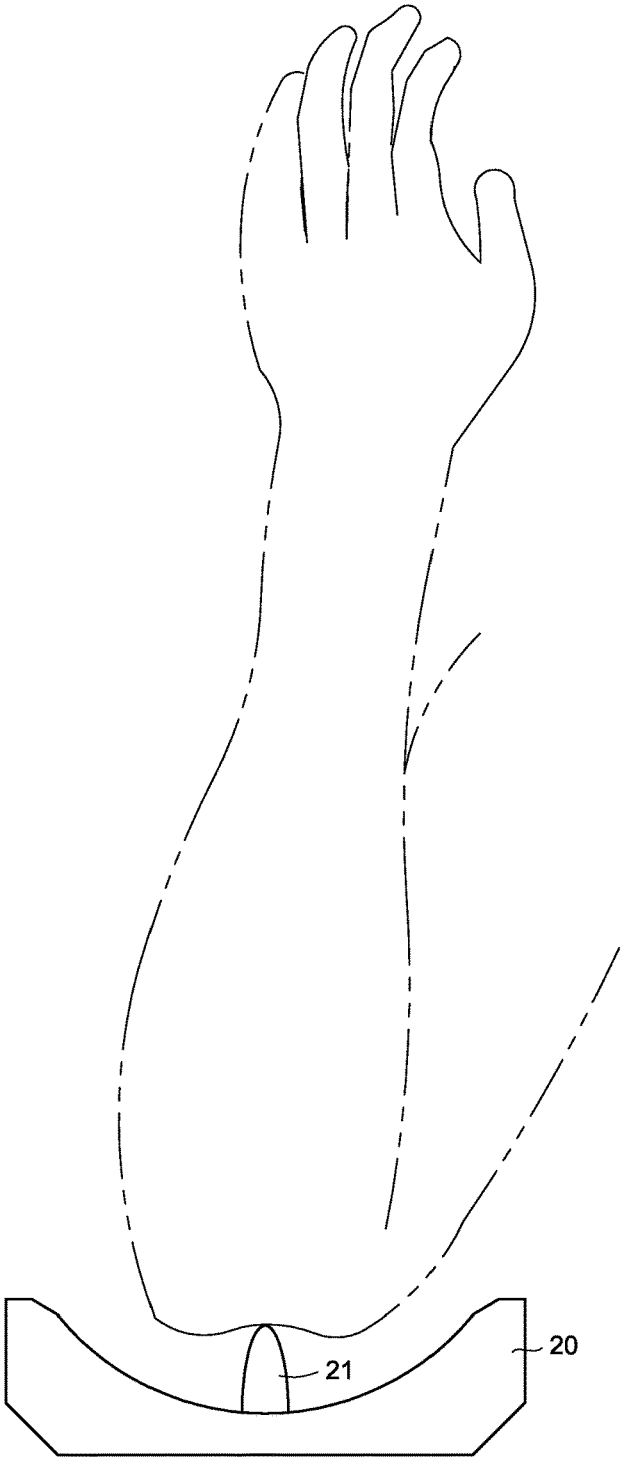
FIG. 4 is a schematic diagram showing an application scenario of a lower member of the carpal tunnel syndrome rehabilitation device of FIG. 1.

The lower member 20, in addition to working with the upper member 10 to improve the discomfort of the carpal tunnel syndrome, may also be applied independently. The lower member 20 may has its flat bottom side rested firmly on a flat surface such as a table top. Then, as shown in FIG. 4, the tip of the bulge element 21 directly contacts the ligament within the olecranon fossa on the back of the elbow joint and provides adequate relaxation and massage to the elbow suffering ligament adhesion or the so-called tennis elbow. The flat bottom side of the lower member 20 provides convenient and reliable positioning without displacement while the elbow is treated, ensuring the elbow safety and operation stability.

As described above, the gist of the present invention lies in the convenient and tight wrapping of the wrist from the upper and lower members 10 and 20 through the strap 22. Then by simple swinging of the palm upward and downward, the wrist ligament is simultaneously massaged and relaxed, thereby easing the pain and discomfort of carpal tunnel syndrome. The lower member 20 may be independently positioned on a flat surface and provides massage and rehabilitation to the elbow suffering the so-called tennis elbow. The strap 22 provides convenient tightening of various degrees. With the present invention, a user without special technique may still conduct simple and effective self-rehabilitation to the wrist and elbow.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A carpal tunnel syndrome rehabilitation device, comprising an upper member, a lower member, and a strap; wherein each of the upper and lower members has a crescent-shaped inner face; an upper bulge element and a lower bulge element are correspondingly positioned in a middle of the inner faces of the upper and lower members, respectively; the upper member has two positioning elements on the inner face, wherein a first positioning element of the two positioning elements is located on a first lateral side of the upper bulge element and a second positioning element of the two positioning elements is located on a second lateral side of the upper bulge element; the positioning elements are slightly lower than the upper bulge element; the strap wraps around outer faces of the upper and lower members so as to tighten the upper and lower members on a wrist from above and below; the upper and lower bulge elements are adapted to press against a gap between the ulna and radius of the wrist from above and below; wherein each of the upper and lower bulge elements has a base with a width between 10 and 15 mm and a length slightly smaller than the width of the upper or lower member; and each of the upper and lower bulge elements shrinks gradually from the base outward for 5 to 10 mm.

2. The carpal tunnel syndrome rehabilitation device according to claim 1, wherein each of the upper and lower bulge elements has a height between 15 and 18 mm.

3. The carpal tunnel syndrome rehabilitation device according to claim 1, wherein the positioning elements are capsule-shaped.

4. The carpal tunnel syndrome rehabilitation device according to claim 1, wherein each of the upper and lower members has slot openings located respectively at two ends for the strap to thread through.

5. The carpal tunnel syndrome rehabilitation device according to claim 1, wherein each of the upper and lower members has two ends and an ear piece extending from each of the ends of the upper and lower members, the ear pieces each including a through opening for the strap to thread through.

6. The carpal tunnel syndrome rehabilitation device according to claim 1, wherein the strap has a fastener section on one side so that the strap locks to itself after tightening the upper and lower members on the wrist.

7. The carpal tunnel syndrome rehabilitation device according to claim 6, wherein the lower member has a flat bottom side.

8. The carpal tunnel syndrome rehabilitation device according to claim 1, wherein each of the upper and lower members has walls along two main edges of the outer face so as to prevent the strap from slipping outside the outer face.

9. The carpal tunnel syndrome rehabilitation device according to claim 1, wherein the lower member is independently placed on a flat surface with the lower bulge element being adapted to directly contact a ligament within an olecranon fossa of an elbow joint to provide adequate relaxation and massage to the elbow joint.

* * * * *